US009897046B2

(12) United States Patent
Engineer

(10) Patent No.: US 9,897,046 B2
(45) Date of Patent: Feb. 20, 2018

(54) INTEGRATED SHORT PATH EQUAL DISTRIBUTION EGR SYSTEM

(71) Applicants: Hyundai America Technical Center, Inc., Superior Township, MI (US); Hyundai Motor Company, Seoul (KR); Kia Motors Corporation, Seoul (KR)

(72) Inventor: Nayan Engineer, Canton, MI (US)

(73) Assignees: Hyundai Motor Company, Seoul (KR); Kia Motors Corporation, Seoul (KR); Hyundai America Technical Center, Inc., Superior Township, MI (US)

( * ) Notice: Subject to any disclaimer, the term of this patent is extended or adjusted under 35 U.S.C. 154(b) by 90 days.

(21) Appl. No.: 14/338,537

(22) Filed: Jul. 23, 2014

(65) Prior Publication Data

US 2016/0025045 A1 Jan. 28, 2016

(51) Int. Cl.

| | |
|---|---|
| ***F02M 25/07*** | (2006.01) |
| ***F02M 26/20*** | (2016.01) |
| ***F02M 26/28*** | (2016.01) |
| ***F02M 26/30*** | (2016.01) |
| ***F02M 26/32*** | (2016.01) |

(52) U.S. Cl.

CPC ..... *F02M 26/20* (2016.02); *F02M 26/28* (2016.02); *F02M 26/30* (2016.02); *F02M 26/32* (2016.02)

(58) Field of Classification Search

CPC ..... F02M 25/07; F02M 25/0715; F02M 25/0723; F02M 25/0726; F02M 25/0727; F02M 25/0737; F02M 25/0747; F28D 2021/0082; F28D 2021/0088; F16L 5/00; F16L 5/10; F16L 5/16; F16L 41/001; F16L 41/08; F16L 41/088; F16L 41/12; F16L 41/121

USPC ..... 123/41.01, 41.79, 193.4, 193.5, 568.12, 123/568.13

See application file for complete search history.

(56) References Cited

U.S. PATENT DOCUMENTS

| | | | | |
|---|---|---|---|---|
| 4,258,687 | A * | 3/1981 | Mauch | F01P 3/18 123/184.33 |
| 6,311,678 | B1 * | 11/2001 | Lepoutre | F28D 7/16 123/184.61 |
| 6,360,702 | B1 * | 3/2002 | Osada | F28D 7/0066 123/196 AB |
| 7,707,997 | B2 * | 5/2010 | Yoon | F28D 7/0075 123/568.12 |
| 2002/0005190 | A1 * | 1/2002 | Bianchi | F02M 26/31 123/568.12 |
| 2006/0005791 | A1 * | 1/2006 | Obidi | F01P 3/02 123/41.29 |
| 2006/0157002 | A1 * | 7/2006 | Pfeffinger | F01P 7/162 123/41.29 |

(Continued)

FOREIGN PATENT DOCUMENTS

| | | | |
|---|---|---|---|
| JP | 2005-299592 | A | 10/2005 |
| JP | 2005337141 | A * | 12/2005 |

(Continued)

OTHER PUBLICATIONS

JP 2005-337141 English Translation Version.*

*Primary Examiner* — John Kwon
*Assistant Examiner* — Johnny H Hoang
(74) *Attorney, Agent, or Firm* — Mintz Levin Cohn Ferris Glovsky and Popeo, P.C.; Peter F. Corless

(57) ABSTRACT

In one embodiment, an exhaust gas recirculation (EGR) system for an engine is disclosed. The EGR system includes an EGR cooler that cools recirculated engine exhaust gas and is mounted between a valve cover and valve train of a cylinder head in the engine.

12 Claims, 4 Drawing Sheets

(56) References Cited

U.S. PATENT DOCUMENTS

| | | | | |
|---|---|---|---|---|
| 2009/0114171 | A1* | 5/2009 | Hayashi | F01P 3/02 123/41.44 |
| 2009/0241864 | A1* | 10/2009 | Sugiura | F01P 3/00 123/41.1 |
| 2010/0170482 | A1* | 7/2010 | Feist | F02M 35/10157 123/568.12 |
| 2012/0085300 | A1* | 4/2012 | Asano | F02M 25/0735 123/41.82 R |
| 2013/0055970 | A1 | 3/2013 | Harada et al. | |
| 2013/0081601 | A1* | 4/2013 | Martins | F02M 25/0722 123/568.12 |
| 2013/0213367 | A1* | 8/2013 | Grosch | F02B 37/00 123/563 |
| 2013/0263797 | A1* | 10/2013 | Sugiura | F01P 3/00 123/41.01 |
| 2014/0137554 | A1* | 5/2014 | Ernst | F02G 5/04 60/615 |
| 2014/0224213 | A1* | 8/2014 | De Pelsemaeker | F02M 35/1045 123/445 |

FOREIGN PATENT DOCUMENTS

| | | | |
|---|---|---|---|
| JP | 4551852 | B2 | 9/2010 |
| JP | 05-180091 | B2 | 4/2013 |
| KR | 10-2001-0014892 | A | 2/2001 |
| KR | 10-0395006 | B1 | 8/2003 |
| KR | 2004-0025212 | A | 3/2004 |

* cited by examiner

INTEGRATED SHORT PATH EQUAL DISTRIBUTION EGR SYSTEM

BACKGROUND (a) Technical Field

The present disclosure generally relates to an exhaust gas recirculation (EGR) system for an engine. In particular, an EGR system having a short path is disclosed that evenly distributes exhaust gas across the cylinders of an engine.

(b) Background Art

One byproduct of internal combustion within an engine is the formation of nitrogen oxide ($NO_x$) gasses. These types of gasses are formed when nitrogen ($N_2$) combines with oxygen ($O_2$) under the high temperatures associated with the combustion process, thereby forming $NO_x$ gasses such as nitric oxide (NO) and nitrogen dioxide ($NO_2$). These gasses can have a number of adverse environmental effects when released into the atmosphere. For example, acid rain, smog, ozone layer depletion, and other adverse environmental effects have been attributed to the release of $NO_x$ gasses into the atmosphere.

To reduce the emission of $NO_x$ gasses by a combustion engine, EGR systems have been developed that recirculate exhaust gasses back into the intake of an engine. The exhaust gasses act as a "dilutant" in the combustion process, resulting in the reduction of pumping losses due to thermal dethrottling. $NO_x$ emissions are reduced since the recirculated gasses can also lower end-of-compression temperatures, thereby lowering combustion temperatures that can lead to the formation of more $NO_x$ gasses. Many EGR systems facilitate this lowering of temperatures by including EGR coolers that cools down the exhaust gasses before introducing the gasses back into the intake of an engine. Typically, these coolers operate by using the coolant of the engine to divert heat from the exhaust gasses.

While modern EGR systems are somewhat effective at reducing the emission of $NO_x$ gasses, this does not come without a price. First, engine efficiency is negatively impacted by virtue of the gas recirculation in an EGR system. Also, modern EGR systems typically add to the bulk, size, and complexity of an engine, which must accommodate the relatively long recirculation paths used by modern EGR systems. In particular, longer EGR paths can lower the response time of the EGR system, affect the response of the engine, etc.

In order to solve the problems in the related art, there is a demand for the development of EGR systems that exhibit better performance, improved fuel efficiency, and are smaller than conventional EGR systems.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention provides systems and methods for recirculating exhaust gas in in an engine in a compact and efficient manner. In particular, a low profile exhaust gas cooler may be employed that uses engine oil as a coolant. The exhaust gas cooler may be located in the engine such that a short recirculation path for the exhaust gas is utilized.

In one embodiment, an exhaust gas recirculation (EGR) system for an engine is disclosed. The EGR system includes an EGR cooler that cools recirculated engine exhaust gas and is mounted between a valve cover and valve train of a cylinder head in the engine. In some aspects, the EGR cooler may also define a plurality of apertures that correspond to spark plug holes in the cylinder head.

According to various aspects, the EGR cooler may use engine oil as a coolant for the recirculated exhaust gas. The EGR cooler may also include a flow path for the engine oil to flow from the EGR cooler to an oil pan of the engine. At least a portion of the engine oil used as a coolant may be splashed onto the EGR cooler by the valve train itself. In one aspect, the EGR cooler receives the engine oil from the cylinder head.

According to various aspects, the EGR system may include an EGR line diverts exhaust gas from an exhaust manifold of the engine to the EGR cooler for cooling. The EGR system may also include an EGR distribution assembly that receives cooled exhaust gas from the EGR cooler and evenly distributes the exhaust gas across the cylinders of the engine. For example, the EGR distribution assembly may evenly distribute the cooled exhaust gas into intake runners of an intake manifold of the engine. The EGR system may include an oil cooler that selectively cools the engine oil and, in some cases, an electronic controller that actuates a bypass valve of the oil cooler to select whether the oil cooler cools the engine oil. The controller may be configured to prevent cooling of the engine oil by the oil cooler during a warm-up phase of the engine.

In one embodiment, an EGR system for an engine is disclosed. The EGR system includes means for cooling recirculated exhaust gas in the engine using engine oil as a coolant. According to various embodiments, the EGR system may include means for evenly distributing the cooled exhaust gas across cylinders of the engine, means for cooling the engine oil, means for selectively controlling when the engine oil is cooled, and/or means for diverting the exhaust gas from an exhaust manifold for cooling.

In one embodiment, a method is disclosed in which exhaust gas is diverted from an engine to an EGR cooler mounted between a valve cover and valve train of a cylinder head in the engine. The exhaust gas is cooled using engine oil from the cylinder head as a coolant. The cooled exhaust gas is also distributed across cylinders of the engine.

According to various embodiments, the method may include pumping the engine oil through an engine oil cooler. In some cases, a bypass valve that controls whether the engine oil is provided to the engine oil cooler may be actuated. The method may also include determining that the engine is in a warm-up phase and actuating the bypass valve to bypass the engine oil cooler during the warm-up phase of the engine.

Advantageously, the systems and methods described herein provide for the recirculation of exhaust gas in an engine in a compact and efficient manner. The short recirculation path of the EGR system allows for a smoother engine response, improved fuel consumption and economy of the engine, and reduces engine friction, among other benefits.

BRIEF DESCRIPTION OF THE DRAWINGS

The above and other features of the present invention will now be described in detail with reference to certain exemplary embodiments thereof illustrated the accompanying drawings which are given herein below by way of illustration only, and thus are not limitative of the present invention, and wherein.

Figure 1:
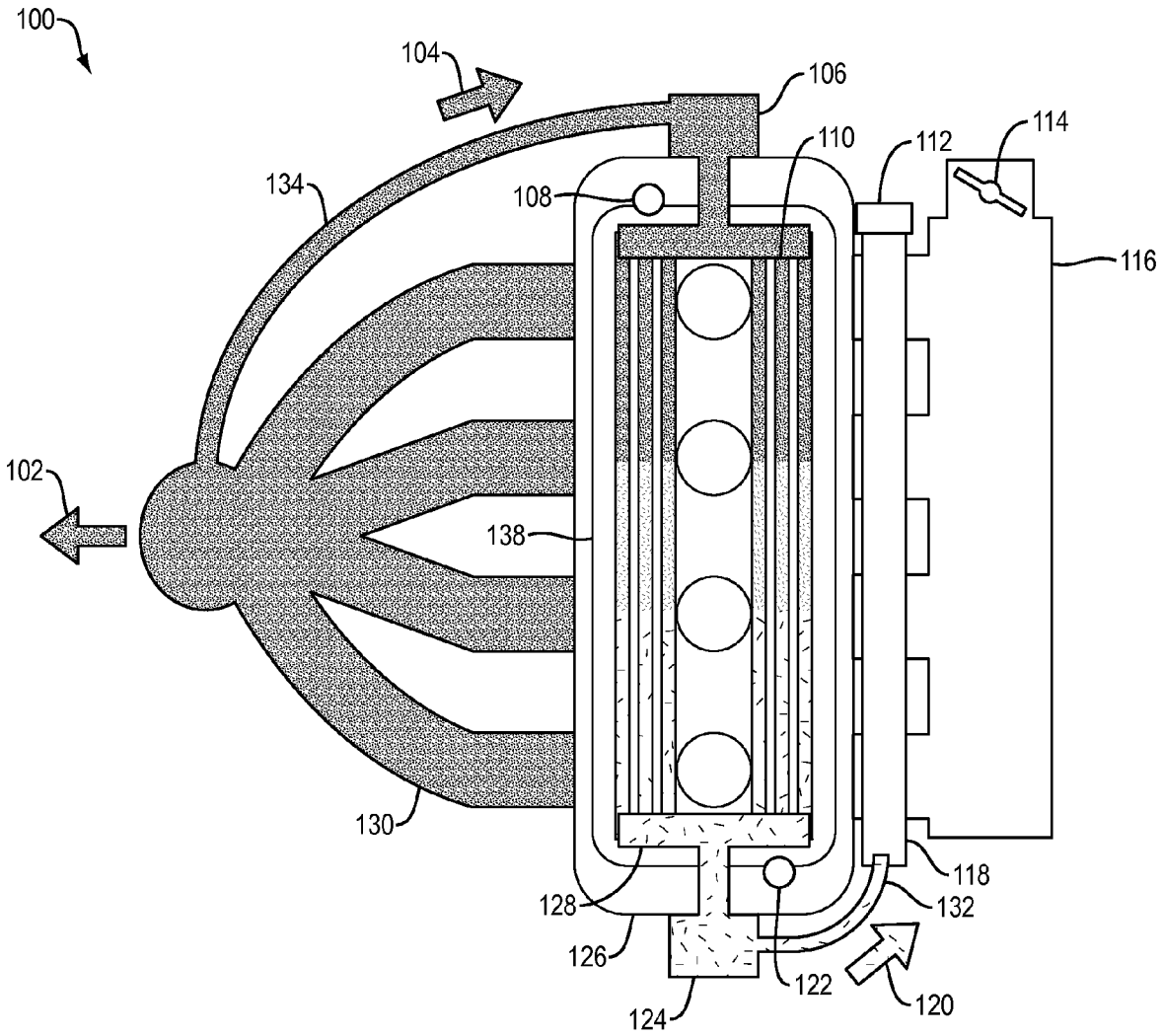
FIG. 1 is a diagram illustrating a top view of an exhaust gas recirculation (EGR) system.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, the present disclosure will be described so as to be easily embodied by those skilled in the art.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Additionally, it is understood that some of the methods may be executed by at least one controller. The term controller refers to a hardware device that includes a memory and a processor configured to execute one or more steps that should be interpreted as its algorithmic structure. The memory is configured to store algorithmic steps and the processor is specifically configured to execute said algorithmic steps to perform one or more processes which are described further below.

Furthermore, the control logic of the present invention may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

The present invention provides an exhaust gas recirculation (EGR) system that utilizes a relatively short recirculation path. In particular, the present invention includes techniques that allow an EGR cooler to use engine oil as a coolant for the exhaust gas, in contrast to many existing systems that use engine coolant to cool the exhaust gas. Also in contrast to existing systems, the cooled gas may also be distributed evenly across the cylinders of the engine by distributing the gasses to each intake runner of the intake manifold of the engine. In some embodiments, techniques are also disclosed that allow the engine oil to be selectively cooled, such as by bypassing an engine oil cooler during a warm-up period of the engine. In doing so, the hotter engine oil reduces engine friction thereby resulting in improved fuel economy of the engine.

According to the present invention, an EGR system for an engine is disclosed. The EGR system includes an EGR cooler that cools recirculated engine exhaust gas and is configured for mounting between a valve cover and valve train of a cylinder head in the engine.

Referring now to FIG. 1, a top view of an EGR system is shown, according to various embodiments. As shown, EGR system 100 includes an EGR cooler 138 configured to cool exhaust gas 102 produced by the engine as a result of combustion. The engine expels exhaust gas 102 via an exhaust manifold 130. At least a portion of exhaust gas 102 is diverted back to EGR cooler 138 via a short path EGR line 134. EGR cooler 138 receives recirculated exhaust gas 104 from EGR line 134, cools the gas, and provides cooled exhaust gas 120 to an EGR distribution assembly 118. EGR distribution assembly 118 then distributes cooled exhaust gas 120 to the valves of the engine via intake manifold 116. Thus, combustion taking place within the engine may utilize intake gas from intake manifold 116, an amount of fuel controlled by a throttle 114, and the recirculated exhaust gas 120. By introducing the exhaust gas back into the combustion process, the amount of $NO_x$ gasses generated by the engine may be reduced.

In various embodiments, EGR cooler 138 utilizes engine oil as a coolant to cool recirculated exhaust gas 104. For example, EGR cooler 138 may include a gas input manifold 106 that receives recirculated exhaust gas 104 from EGR line 134 and directs gas 104 along a plurality of EGR cooler lines 110. Cooler lines 110 may operate as a gas-to-oil heat exchanger that transfers thermal energy present in recirculated exhaust gas 104 into the engine oil, which is then diverted away from EGR cooler 138. Thus, cooled exhaust gas 128 may result at the end of EGR cooler 138 opposite gas input manifold 106 and routed into a gas output manifold 124 of EGR cooler 138. Gas output manifold 124 may then provide cooled exhaust gas 120 through an EGR line 132 that coupled EGR cooler 138 to EGR distribution assembly 118 for distribution of the gas back into the combustion chambers of the engine.

EGR cooler 138 may be a low-profile cooler configured for mounting under a valve cover 126 of the engine (i.e., above the valve train of the cylinder head of the engine). Advantageously, this location allows EGR line 134 to be relatively short when routing both high pressure and low pressure EGR gasses (e.g., low pressure gasses from a turbo) back to EGR cooler 138. Similarly, the location of EGR cooler 138 allows EGR line 132 to also be short, when directing cooled exhaust gas 120 for distribution back to the valves of the engine. The shortened overall path of exhaust gas within EGR system 100 thereby increases the response time of system 100 and provides for a smoother engine response.

In some aspects, engine oil may be provided to EGR cooler 138 directly from the cylinder head of the engine. For example, as shown, EGR cooler 138 may include one or more oil input ports 122 that are coupled to the oil supply channel of the cylinder head. In one embodiment, the oil may flow through EGR cooler 138 in a cross-flow manner relative to the flow of exhaust gas 104, allowing for effective cooling of the exhaust gas flowing through cooler lines 110. The engine oil may then be diverted away from EGR cooler 138 through one or more oil drains 108. In some cases, the one or more oil drains 108 may correspond to holes in the cylinder head and engine block already used by the engine to deliver engine oil back to the oil pan of the engine.

Figure 2:
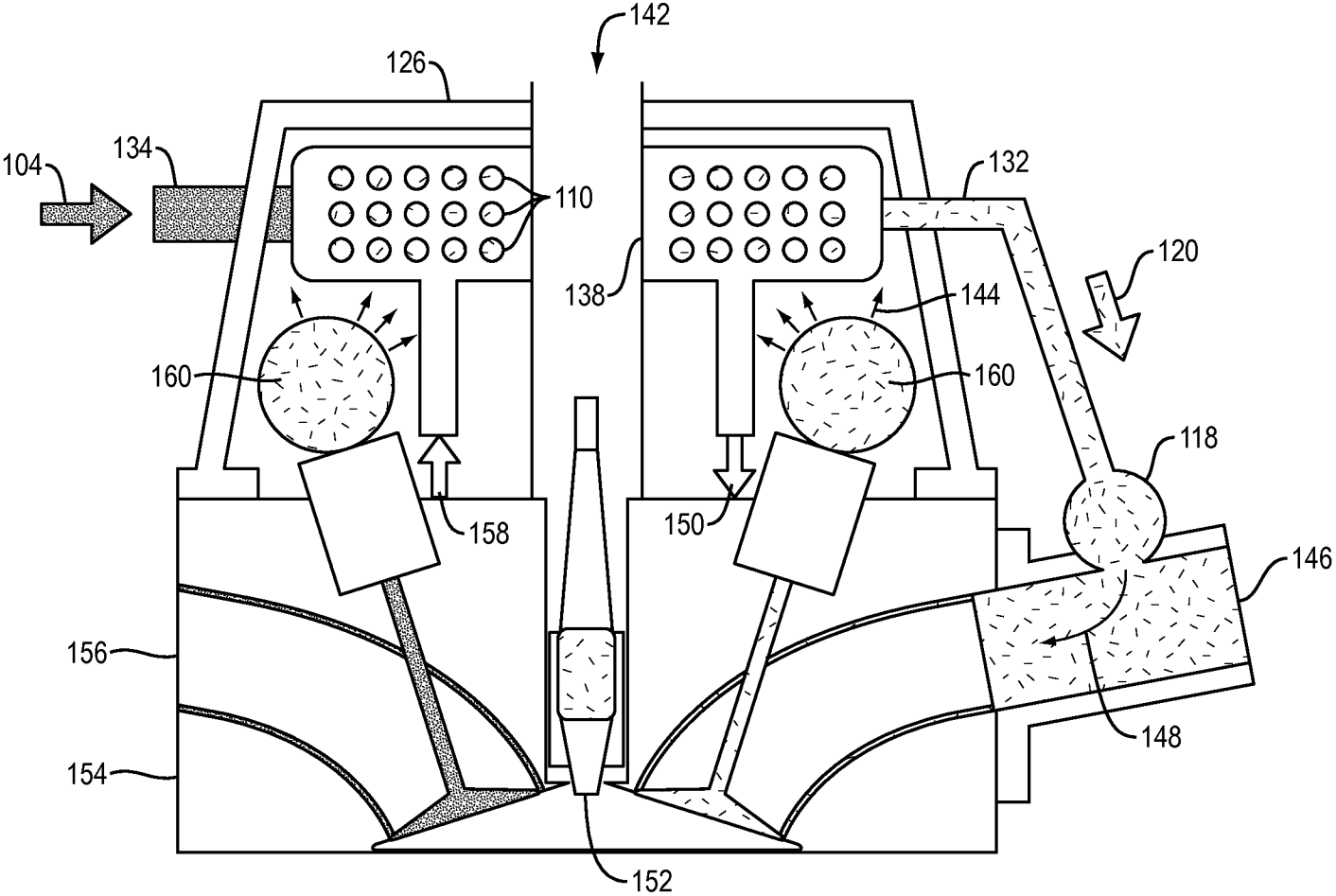
FIG. 2 is a diagram illustrating a cross-sectional side view of the EGR system of FIG. 1.

Referring now to FIG. 2, a cross-sectional side view of EGR system 100 is shown, according to various embodiments. As shown, EGR cooler 138 may be located between valve cover 126 and the valve train of cylinder head 154. In one embodiment, EGR cooler 138 may include a plurality of apertures that correspond to spark plug holes of the engine. For example, as shown, cylinder head 154 may include a spark plug hole 142 in which spark plug 152 is located. Spark plug 152 initiates the combustion of fuel within the engine, thereby driving valve train camshafts 160. As will be appreciated, EGR cooler 138 may be adapted to accommodate any number of spark plugs and engine cylinders using the teachings herein. Also, while a dual overhead cam (DOHC) configuration is shown in FIG. 2, EGR cooler 138 may be adapted for use with other engine layouts using the teachings herein.

As discussed above, exhaust gas produced by combustion is routed through an exhaust port 156 and into exhaust manifold 130. At least a portion of this gas (i.e., exhaust gas 104) is then diverted back towards the engine by EGR line 134 and provided to EGR cooler 138. Engine oil from cylinder head 154 is used within EGR cooler 138 to cool exhaust gas 104. As shown, for example, a pressurized cooling oil feed line 158 may supply engine oil to EGR cooler 138 to cool exhaust gas 104. The engine oil from EGR cooler 138 may also follow a return path 150 via which the engine oil drains back into the engine. In some embodiments, EGR cooler 138 may also be mounted in close proximity to valve train camshafts 160, to allow some of the engine oil 144 to splash onto EGR cooler 138, thereby providing even greater cooling to exhaust gas 104.

Once exhaust gas 104 has been cooled by EGR cooler 138, EGR cooler 138 provides cooled exhaust gas 120 to EGR distribution assembly 118. In one embodiment, EGR distribution assembly 118 may evenly distribute cooled exhaust gas 120 to the intake runners of intake manifold 108. As shown, for example, EGR distribution assembly 118 may distribute cooled exhaust gas 120 to the cylinder via a path 148 that extends through intake runner 146 of intake manifold 116. Path 148 allows for a shortened overall path for the exhaust gas within EGR system 100, thereby reducing the response time of the system and providing other benefits.

Figure 3:
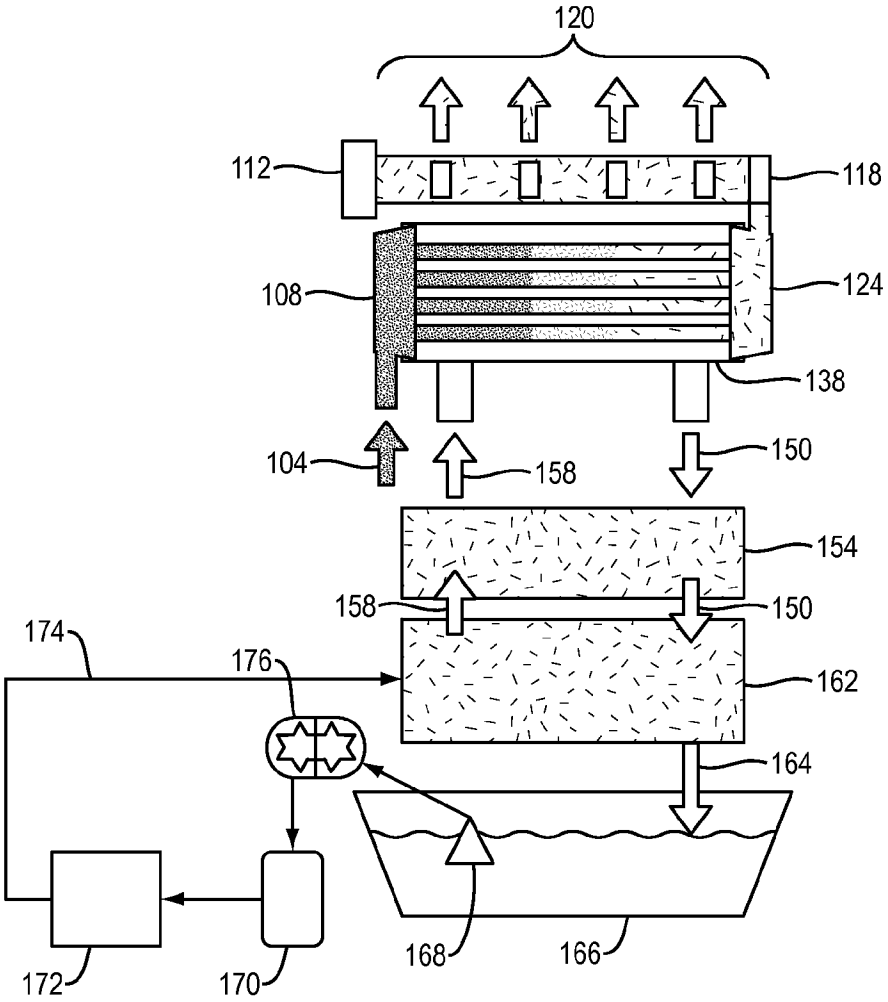
FIG. 3 is a diagram illustrating an exploded view of the EGR system of FIG. 1.

Referring now to FIG. 3, an exploded view of EGR system 100 is shown, according to various embodiments. As highlighted above, EGR cooler 138 may utilize oil from the engine to transfer heat away from recaptured exhaust gas 104. In particular, exhaust gas 104 travels through input manifold 108 of EGR cooler 138 and is cooled by engine oil fed to EGR cooler 138 via feed line 158. The resulting cooled exhaust gas 120 is then routed through gas output manifold 124 and into EGR distribution assembly 118, which returns the exhaust gas to the cylinders. In some cases, EGR distribution assembly 118 may also include an EGR distribution valve 112 that regulates the flow of exhaust gas back into the engine.

In some embodiments, engine oil feed line 158 may extend through cylinder head 154 from engine block 162. In some cases, the oil through feed line 158 may also be pressurized via an oil pump 176 that pumps engine oil collected in oil pan 166 back to engine block 162 via feed line 174. For example, oil pump 176 may include or be otherwise coupled to an oil pump pickup 168 located within oil pan 166. This oil may be used as a lubricant for the engine's valve train, as well as to provide cooling to exhaust gas 104. In one embodiment, the oil supply system may include an oil filter 170 that receives and filters the oil pumped from oil pan 166.

In various embodiments, an oil cooler 172 may be coupled to feed line 174, to cool the oil before returning the oil to engine block 162. Oil cooler 172 may include a bypass valve that can be actuated to control whether oil flowing along line 174 is cooled by oil cooler 172. In one embodiment, an engine controller such as an engine control unit (ECU) or other controller) may control the actuation of the bypass valve based on the state of the engine. For example, if the engine is in a warm-up phase, oil cooler 172 may be bypassed to help increase the temperature of the engine oil. By using hotter oil to lubricate the engine, engine friction may be reduced, leading to better fuel economy within the engine. Once the oil has reached a suitable temperature (i.e., a desired operating temperature), the oil may be diverted through oil cooler 172 as necessary to maintain this temperature.

After the engine oil passes through EGR cooler 138, the oil may be returned via path 150 through cylinder head 154 and engine block 162 into oil pan 166. In one embodiment, return path 150 may be a shared oil return path that is also used by the engine to return oil from the valve train back to oil pan 164 (e.g., oil that may have been used to lubricate the valve train). For example, the oil may return to oil pan 164 via one or more drains 164 that extend through engine block 162.

Figure 4:
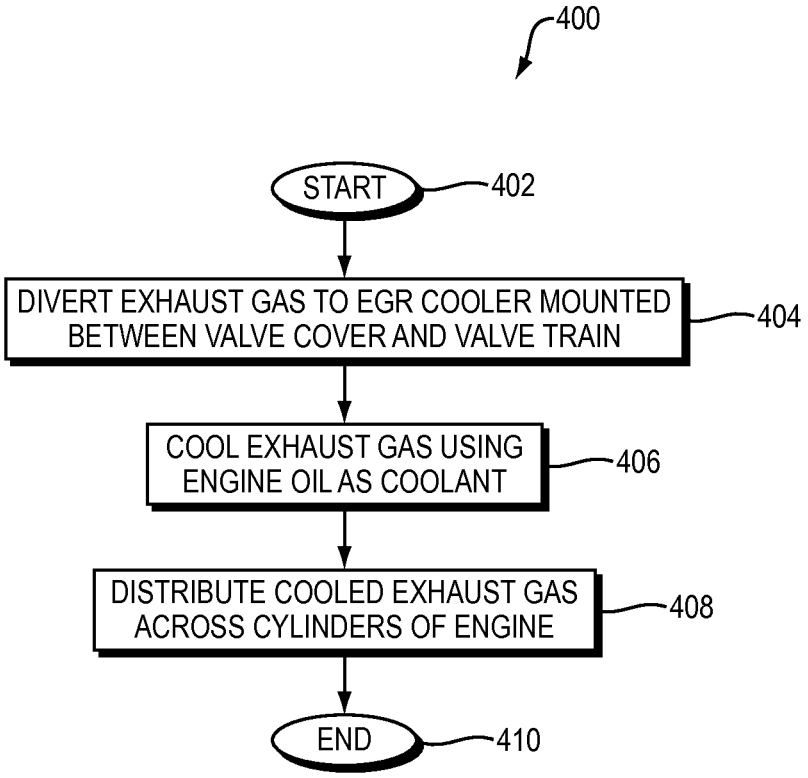
FIG. 4 is an example simplified procedure for recirculating exhaust gas in an engine.

Referring now to FIG. 4, an example simplified procedure is shown for recirculating exhaust gas in an engine, according to various embodiments. Procedure 400 starts at a step 402 and continues on to step 404 where, as detailed above, exhaust gas from the engine is diverted to an EGR cooler mounted between the valve cover and valve train of the engine. For example, a short path feed line may divert at least a portion of the exhaust gas from the exhaust manifold of the engine back to the EGR cooler for cooling. At step 406, the exhaust gas is cooled by the EGR cooler using engine oil as the coolant, as described in greater detail above. In various embodiments, the oil supply chain of the engine may be configured to route a portion of the engine oil through the EGR cooler. In some cases, further cooling may be provided by engine oil being splashed onto the EGR cooler from the valve train, if the EGR cooler is mounted in close enough proximity to the valve train. Procedure 400 continues on to step 408 where, as detailed above, the cooled exhaust gas is distributed across the cylinders of the engine. In various embodiments, an EGR distribution assembly may evenly distribute the cooled exhaust gas back into each intake runner of the engine's intake manifold. Procedure 400 then ends at step 410.

It should be noted that some or all of the steps of procedure 400 may be optional and that the steps depicted in FIG. 4 are merely examples. Certain other steps may be included or excluded from procedure 400 as desired, according to the teachings herein. Further, while a particular ordering of steps is shown in FIG. 4, this ordering is merely illustrative and any suitable arrangement of the steps may be utilized without departing from the scope of the embodiments herein.

While the embodiment of the present disclosure has been described in detail, the scope of the right of the present disclosure is not limited to the above-described embodiment, and various modifications and improved forms by those skilled in the art who use the basic concept of the present disclosure defined in the appended claims also belong to the scope of the right of the present disclosure.

What is claimed is:

1. An exhaust gas recirculation (EGR) system for an engine, comprising:

an EGR cooler that cools recirculated engine exhaust gas and is mounted between a valve cover and valve train of a cylinder head in the engine, the EGR cooler including a plurality of parallel EGR cooler lines that direct the recirculated exhaust gas through the EGR cooler, wherein the EGR cooler cools the recirculated exhaust gas using engine oil as a coolant, and wherein the EGR cooler receives the engine oil directly from the cylinder head.

2. The system as in claim 1, further comprising:

an EGR line that diverts exhaust gas from an exhaust manifold of the engine to the EGR cooler for cooling.

3. The system as in claim 1, further comprising:

an EGR distribution assembly that receives cooled exhaust gas from the EGR cooler and to evenly distribute the exhaust gas across cylinders of the engine.

4. The system as in claim 3, wherein the EGR distribution assembly that evenly distributes the cooled exhaust gas into intake runners of an intake manifold of the engine.

5. The system as in claim 1, wherein the EGR cooler comprises a flow path for the engine oil to flow from the EGR cooler to an oil pan of the engine.

6. The system as in claim 1, further comprising:

an oil cooler that selectively cools the engine oil.

7. The system as in claim 6, further comprising:

an electronic controller that actuates a bypass valve of the oil cooler to select whether the oil cooler cools the engine oil, wherein the controller is configured to prevent cooling of the engine oil by the oil cooler during a warm-up phase of the engine.

8. The system as in claim 1, wherein:

at least a portion of the engine oil used as the coolant is splashed onto the EGR cooler by the valve train, and the EGR cooler is mounted in close proximity to a camshaft of the valve train.

9. The system as in claim 1, further comprising:

an EGR line coupled to the EGR cooler, wherein the engine oil is provided to the EGR cooler and flows through the EGR cooler.

10. The system as in claim 1, wherein the engine oil flows in a cross-flow manner relative to the recirculated engine exhaust gas flowing through a cooler line.

11. The system as in claim 1, wherein the EGR cooler includes at least one oil input port coupled to an oil supply channel of the cylinder head and at least one oil drain, and wherein the oil drain delivers the engine oil back to an oil pan of the engine.

12. A method comprising:

diverting exhaust gas from an engine to an exhaust gas recirculation (EGR) cooler mounted between a valve cover and valve train of a cylinder head in the engine, the EGR cooler including a plurality of parallel EGR cooler lines that direct the recirculated exhaust gas through the EGR cooler;

cooling the exhaust gas using engine oil from the cylinder head as a coolant; and distributing the cooled exhaust gas across cylinders of the engine, wherein the engine oil is supplied to the EGR cooler directly from the cylinder head or through an engine oil cooler, and wherein the engine oil is supplied to the EGR cooler directly during a warm-up phase of the engine.

* * * * *